US009422089B2

(12) United States Patent
Wheeler

(10) Patent No.: US 9,422,089 B2
(45) Date of Patent: Aug. 23, 2016

(54) EXPANDING SEALING LOCKING SYSTEMS AND METHODS

(75) Inventor: Jasper E. Wheeler, Brooklyn, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 354 days.

(21) Appl. No.: 13/366,207

(22) Filed: Feb. 3, 2012

(65) Prior Publication Data

US 2012/0199588 A1 Aug. 9, 2012

Related U.S. Application Data

(60) Provisional application No. 61/439,689, filed on Feb. 4, 2011.

(51) Int. Cl.
*B65D 39/12* (2006.01)
*B65D 41/04* (2006.01)

(52) U.S. Cl.
CPC ..... *B65D 41/0414* (2013.01); *B65D 39/12* (2013.01)

(58) Field of Classification Search
CPC ..... F16J 13/12; F16L 55/132
USPC ..... 215/360, 359, 358, 342, 296, 294, 355, 215/212, 228; 220/806, 800, 238, 237, 234, 220/233, 235
See application file for complete search history.

(56) References Cited

U.S. PATENT DOCUMENTS 666,911 A * 1/1901 Steinberg ..... 215/360
2,046,224 A * 6/1936 Vanderhoof ..... 215/296
2,718,974 A * 9/1955 Helbig ..... 215/360
3,091,358 A * 5/1963 Simpkins ..... 220/238
3,451,541 A * 6/1969 Posso ..... 206/406
4,579,237 A 4/1986 Gagnon
4,858,760 A 8/1989 Di Sturco
5,056,676 A 10/1991 Allen et al.
5,161,711 A 11/1992 Picozza et al.
5,803,288 A 9/1998 Munini
6,394,295 B2 5/2002 Claude
6,915,920 B2 * 7/2005 Hwang et al. ..... 215/358
2001/0019033 A1 9/2001 Montgomery
2005/0092707 A1 5/2005 Chantalat
2006/0151422 A1 7/2006 Manley
2010/0012614 A1 1/2010 Dubs et al.
2010/0084366 A1 4/2010 Miller
2011/0011862 A1 1/2011 Matsumoto et al.
2012/0061392 A1 * 3/2012 Beach et al. ..... 220/23.83

OTHER PUBLICATIONS

International Search Report and Written Opinion dated May 25, 2012 for related PCT Application No. PCT/US2012/023867.

* cited by examiner

*Primary Examiner* — J. Gregory Pickett
*Assistant Examiner* — Allan Stevens
(74) *Attorney, Agent, or Firm* — Tutunjian & Bitetto, P.C.

(57) ABSTRACT

Disclosed are devices and methods for sealing containers. The device can include a seal, a spring, and an eccentric or ramp. In a first position, the spring and the seal can be retracted enabling the device to be placed in the opening of a container. In a second position, the spring can expand the seal enabling it to seal against a sealing surface of the container. The device can create a replaceable bottle cap assembly that conforms to the top of a non-threaded beverage container. The device can provide a lid for a variety of storage containers, including food storage containers. The device can form a watertight or airtight seal. The device can be used to form a movable lid for a container or to join multiple containers together.

12 Claims, 15 Drawing Sheets

Section A-A

EXPANDING SEALING LOCKING SYSTEMS AND METHODS

CROSS-REFERENCE TO RELATED APPLICATIONS

This application claims the benefit of U.S. Provisional Application Ser. No. 61/439,689, filed 4 Feb. 2011, which is incorporated herein by reference in its entirety as if fully set forth below.

BACKGROUND OF THE INVENTION

1. Field of the Invention

The invention relates to the field of bottles and containers, and in particular, to locking systems that can be used to seal a variety of bottles and containers.

2. Description of the Related Art

A variety of beverage and food storage containers are known. Some, like soda cans, are intended for single use and therefore are sealed only when unopened. Once opened using a "pop-top," for example, the container cannot, nor need not, be resealed. Other containers, like plastic beverage bottles used for soda and bottled water, can be resealed after opening. These containers provide a threaded cap and rim that can be resealed, preventing spillage while maintaining freshness. These containers are not necessarily designed for prolonged use, however, as the plastic materials of both the bottle and the cap eventually deteriorate.

A wide variety of other storage containers exist with an equally wide variety of sealing mechanisms. Traditional Tupperware®, for example, uses a plastic bottom container in conjunction with a lid comprising a groove that cooperatively mates with the sidewalls of the container. The lid is placed on top of the container and pushed down to force the groove in the lid over the walls of the container, creating a seal.

A variety of mechanisms also exist that are intended to seal reusable beverage containers, such as reusable water bottles. The popularity of these reusable containers has grown with consumer awareness of the environmental implications of single-use plastic beverage containers. These mechanisms vary from screw-on tops with resilient seals, i.e., o-rings, to hinged tops with latching mechanisms. These mechanisms work well enough for their intended purposes, but tend to degrade as the o-rings or seals become worn or compressed or as the latches break.

What is needed, therefore, is a robust sealing system adaptable for use with a variety of containers that positively seals the container in a repeatable way with minimal wear to the sealing surfaces. It is to such a system that embodiments of the present invention are primarily directed.

SUMMARY OF THE INVENTION

Embodiments of the present invention relate to a sealing system, and more specifically to an assembly for sealing containers while providing an airtight and/or watertight seal. The assembly can be an expanding seal locking assembly and can comprise a seal, a ramp, and a spring mechanism. The assembly seals many shapes and sizes of containers. The assembly can further comprise a knob or handle to facilitate the ramp to be turned by hand. The spring mechanism incorporates an expanded position and a contracted position.

A unique feature of the sealing system assembly is that it can expand and lock tightly in a bottle or container. The system expands radially out from the center causing the soft seal to grip the inside rim/neck of a bottle or container. The system eliminates the need for a traditional threaded connection between the neck of a bottle and a cap for the bottle.

The sealing system can be operated by first pushing the sealing mechanism assembly down into the container or bottle until it cannot go any further. Then, a user turns the handle or gripping surface until it clicks in a locked position, creating a watertight and/or airtight seal. To remove the system from the bottle or container, a user turns the handle or gripping surface in the opposite direction. The mechanism will release and the seal will contract, allowing the system to be removed from the bottle or container.

The expanding sealing system can be used as a lid sealing mechanism across a variety of products. For example, it can be used in threadless water bottle and a food storage container.

In a basic form, the system comprises a cylindrical ramp that can be made from hard plastic or metal, a spring mechanism made from flexible plastic, and a seal made from flexible rubber or silicone. The spring mechanism can be made of almost any flexible plastic, including nylon or polypropylene.

The assembly can seal a threadless bottle. In this embodiment, the assembly is substantially round, and can incorporate three parts. A first part is a cap. The cap has a top portion, an outer wall, and an inner wall. The top portion serves as a cover for the top of the bottle when the bottle is sealed. The outer wall can be cylindrical, extends downwardly from the top portion, and is designed to be easily grippable by a user. In this manner, a user can hold the cap, place it on a bottle, and turn the cap to create a seal. Like the outer wall, the inner wall can be cylindrical. The inner wall is designed so that, when the cap is on the bottle, the inner wall extends downwardly from the top portion and into the mouth of the bottle. The inner wall has at least one ramp, and preferably three, on the outer surface. The ramps are portions of the inner wall that gradually extend radially outward from the central axis of the cap.

A second part of the assembly is a spring mechanism. The spring mechanism is a cylindrical piece of plastic that expands and contracts radially. The spring mechanism has curved wall portions that are joined together by arms. The arms can flex, and this flexing motion enables the spring mechanism to expand and contract. The spring mechanism also has sliding portions on its inner surface. The sliding portions can be plastic elements that extend radially inward toward the central axis of the spring mechanism.

In use, the spring mechanism is placed around the inner wall of the cap. The sliding portions are therefore disposed on the ramps of the inner wall, and can slide on the ramps. In this manner, when a user rotates the cap relative to the spring mechanism, the sliding portions slide along the ramps, causing the spring mechanism to expand radially outward. When the cap is rotated in the opposite direction, the spring force in the arms will cause the spring mechanism to contract radially inward.

A third part of the assembly is an insert or seal. The seal can be silicon, and can also be substantially cylindrical. The seal fits around the spring mechanism when the spring mechanism is placed around the inner wall of the cap such that the spring mechanism engages the seal. The seal can have various ribs on its outer surface that help create a watertight and/or airtight seal.

In use, when the spring mechanism is in a contracted position, the assembly can be placed on top of a bottle. The inner wall of the cap, the spring mechanism, and the seal then extend into the mouth of the bottle. Once the assembly is on the bottle, a user can rotate the cap from a first position to a second position by rotating the outer wall of the cap. This action rotates the ramps of the inner portion relative to the spring mechanism, thereby causing the spring mechanism to expand. The seal thus expands, and presses against the mouth of the bottle. Once pressed against the mouth, the ribs on the seal form a watertight and/or airtight seal. The bottle is now sealed, and can be transported or stored without the risk of spilling.

When the user wants to remove the assembly from the bottle, the user simply rotates the cap in the opposite direction. The ramps rotate in the same direction as the cap, thereby allowing the spring mechanism to contract. When the spring mechanism contracts, the device can be removed from the mouth of the bottle.

This process can be repeated without risk of rapid deterioration of the components of the assembly, such as the seal. Thus, the present invention provides an improved assembly for repeatedly sealing, and unsealing, a threadless bottle.

The assembly can similarly be an assembly useful in sealing a food storage container. In this manner, the assembly can comprise a lid for the container. The container can be any number of shapes, including square or rectangular. When in use with a food storage container, the lid functions in a similar manner as to the bottle sealing device described above.

The lid can have a rotatable, grippable handle on its top. The handle is connected to a ramp assembly that is contained within the lid. The ramp assembly, like the inner wall of the cap, discussed above, is cylindrical with one or more ramps on an outer surface. The handle and the ramp assembly are connected in such a way that when a user rotates the handle, the ramp assembly rotates with the handle.

The lid also has a spring mechanism. The spring mechanism is contained within the lid, and has an inner portion and an outer portion. The inner portion and the outer portion are connected by fingers that extend radially. The outer portion of the spring mechanism has the same shape as the container. The inner portion of the spring mechanism is cylindrical, and fits around the outside of the ramp assembly. The inner portion also has sliding portions that slide on the ramps of the ramp assembly. The sliding portions extend radially inward from the inner portion of the spring mechanism.

In use, when the handle is rotated, the ramp assembly rotates relative to the spring mechanism, causing the sliding portions of the spring mechanism to slide on the ramps and be pushed radially outward. This causes the inner portion of the spring mechanism to expand. The fingers are pushed outward when the inner portion of the spring mechanism expands, causing the outer portion of the spring mechanism to expand. Thus, rotating the handle in a first direction causes the outer portion of the spring mechanism to expand toward the inner wall of the container.

A silicon insert or seal is placed on the lid around the spring mechanism. The seal is substantially the same shape as the container and the outer portion of the spring mechanism. The seal engages the outer portion of the spring mechanism, and for this reason, the seal expands when the spring mechanism expands. When the seal expands, the seal presses against the inner wall of the container. To help create a watertight or airtight connection against the container, the seal optionally can have ribs on its outer surface.

The functionality of the lid embodiment is also similar to the functionality of the cap embodiment. When the handle rotates to place the spring mechanism in its contracted position, the lid can be placed inside the inner lip of the container. Once the lid is inside the container, a user can rotate the handle from a first position to a second position. The rotation of the handle turns the ramp assembly, thereby causing the ramps to push on the spring mechanism, which causes the inner portion of the spring mechanism to expand. The fingers therefore push on the outer portion of the spring mechanism, which causes the outer portion to expand. In turn, the seal expands and presses against the container. The ribs on the seal then form a watertight and/or airtight seal against the container. The container is now sealed, and food can be stored inside the container for prolonged periods of time with reduced risk of spoilage.

To open the container, the handle is rotated in the opposite direction. The ramp assembly rotates in the same direction as the handle, thereby allowing the spring mechanism to contract and the seal to contract. The lid can now be removed from the container.

The opening and closing process can be repeated without the risk of rapid deterioration of the seal, or otherwise rapidly wearing out the components of the lid. The present invention therefore provides an improved lid for sealing a food storage container.

The assembly can be used to seal the internal surface of a variety of containers. In some embodiments, an assembly can be round and can be used to seal, for example and not limitation, beverage containers or bottles. In other embodiments, an assembly can be, for example and not limitation, square, rectangular, pentagonal, hexagonal, or octagonal, and can be used to seal, for example, food storage containers. An assembly can comprise the spring mechanism. The device can easily be placed in the opening of the container when the spring mechanism is contracted. Once in place in the container, the handle can be rotated to place the spring mechanism into the expanded position to provide a tight seal. The handle can comprise a detent to hold the handle, and thus the seal, when the spring mechanism is in the expanded position, the contracted position, or both.

In some embodiments, the assembly need not include the seal, and the assembly comprises the ramp and the spring mechanism. In this configuration, the assembly can be used as an expanding lock to secure a variety of containers without necessarily providing an airtight or watertight seal. This can be useful, for example and not limitation, in the packaging of dry goods or to secure doors or hatches on vehicles. In some embodiments, the spring mechanism can further comprise tabs that can be inserted into holes in the container to provide additional security.

In some embodiments, the present invention can be a threadless container sealing system. The system can comprise a cap having an inner portion and an outer portion joined by a top portion. The inner and outer portions can be substantially cylindrical and can extend downwardly from the top portion. The inner portion can also have at least one ramp disposed on an outer surface of the inner portion.

The present invention can also comprise a substantially cylindrical spring mechanism disposed on the inner portion of the cap. The spring mechanism can be engaged with at least one ramp of the inner portion of the cap such that when the cap rotates relative to the spring mechanism from a first position to a second position, at least one ramp expands the spring mechanism.

In some embodiments, an insert can be engaged with the spring mechanism and can be expandable when the spring mechanism expands. The insert can also have an outer surface for sealing against a bottle or container, for example.

In some embodiments, the spring mechanism can be located between the inner portion of the cap and the insert. When the cap is in the first position the insert can be in a contracted state, and when the cap is in the second position the insert can be in a sealing state.

The spring mechanism can expand radially outward when the cap rotates from the first position to the second position. The spring mechanism can also comprise at least one arm portion. The insert can comprise one or more ribs on the outer surface of the insert, and can optionally comprise a seal flange on the outer surface of the insert.

In some embodiments, the system further comprises a container. The outer surface of the insert can seal the opening of the container when the insert is the sealing state. The sealing state can be substantially watertight.

In some embodiments, the spring mechanism can comprise at least one arm portion, one or more ribs on the outer surface of the insert, and a seal flange on the outer surface of the insert. The at least one arm portion can flex to expand the spring mechanism. The ribs and the seal flange can also create a substantially watertight seal against the bottle or container. In some embodiments, the cap can comprise one or more detents to hold the cap in one or both of the first position and the second position.

In some embodiments, the insert can comprise silicone. In some embodiments, the spring mechanism can comprise nylon, or one of polypropylene or steel.

In some embodiments, the present invention can be a container sealing system comprising a lid. The lid can comprise a rotating assembly having and outer surface and a top. The rotating assembly can have at least one ramp on the outer surface and a handle on the top.

The lid can also comprise a spring mechanism having an inner portion and an outer portion. The inner portion can be engaged with at least one ramp of the rotating assembly such that when the rotating assembly rotates relative to the spring mechanism from a first position to a second position, at least one ramp expands the inner portion of the spring mechanism outwardly.

The lid can also comprise a seal engaged with the outer portion of the spring mechanism. The seal can be expandable when the spring mechanism expands. The seal can also have an outer surface for sealing against a bottle or container.

In some embodiments, the outer portion of the spring mechanism can expand when the inner portion of the spring mechanism expands. The rotating assembly cab also be disposed at least partially within the inner portion of the spring mechanism. When the rotating assembly is in the first position the lid can be in a contracted state, and when the rotating assembly is in the second position the lid can be in a sealing state.

In some embodiments, the rotating assembly can comprise one or more detents to hold the rotating assembly in one or both of the first position and the second position. In some embodiments, the inner portion of the spring mechanism is connected to the outer portion of the spring mechanism by fingers.

In some embodiments, the seal can be a friction ring. In some embodiments, the spring mechanism can also comprise a plurality of elements. The elements can be connected by a plurality of flexible joints. In some embodiments, the spring mechanism comprises four elements.

In some embodiments, the seal comprises silicone, or the seal can comprise one of natural or synthetic rubber, foam, or plastic. The seal can comprise a substantially smooth outer surface. The seal can also comprise one or more ribs on an outer surface of the seal.

In some embodiments, the lid further comprises a lower lid. In some embodiments, the lid further comprises an upper lid.

In some embodiments, the system can further comprise a container having an opening. In some embodiments, the lid can fit at least partially within the opening of the container when the lid is in the contracted state. In some embodiments, the outer surface of the seal can seal against the container when the lid is in the sealing state. The sealing state can be substantially watertight. The seal can also apply pressure to the container in a direction substantially normal to an inner rim of the container.

The opening of the container and the outer portion of the spring mechanism can be substantially round. The opening of the container and the outer portion of the spring mechanism can also be substantially square or rectangular. The opening of the container and the outer portion of the spring mechanism can also be substantially pentagonal, hexagonal, or octagonal.

In some embodiments, the invention can comprise a method of sealing a container. The method can comprise placing a top at least partially within the container. The top can comprise a substantially cylindrical rotating portion having an outward-facing surface. The rotating portion can have at least one ramp disposed on the outward-facing surface. The top can also have a gripping portion connected to the rotating portion, a spring mechanism engaged with at least one ramp of the rotating portion, and an insert engaged with the spring mechanism such that the insert expands when the spring mechanism expands.

In some embodiments, the spring mechanism can be located at least partially within the insert, and the rotating portion can be located at least partially within the spring mechanism. Moreover, in some embodiments, when the gripping portion is in the first position the top can be in a contracted state, and when the gripping portion is in the second position the top can be in a sealing state.

In some embodiments, the method can further comprise turning the gripping portion and the rotating portion from a first position to a second position such that the at least one ramp rotates relative to the spring mechanism and causes the spring mechanism to expand outwardly. The expansion of the spring mechanism can cause the insert to expand outwardly and seal against the container.

In some embodiments, the gripping portion and the rotating portion can be turned from the second position to the first position. This turning can cause the insert to contract inwardly, and the top can then be removed from the container.

In some embodiments, the rotating portion can be turned until the spring mechanism engages at least one detent of the rotating surface. The at least one detent can be adapted to maintain the rotating surface in one or both of the first position and the second position.

In some embodiments, the insert can exert a force on the container in a direction substantially normal to an inner rim of the container. In some embodiments, the expansion of the insert causes a substantially watertight seal between the insert and an inner rim of the container.

In some embodiments, the present invention can comprise a sealing system for sealing a threadless bottle. The sealing system can comprise a cap having an inner portion and an outer portion joined by a top portion. The inner and outer portions can be substantially cylindrical and can extend downwardly from the top portion. The inner portion can have at least one ramp disposed on an outer surface of the inner portion.

In some embodiments, the sealing system can further comprise a substantially cylindrical spring mechanism disposed on the inner portion of the cap. The spring mechanism can be engaged with at least one ramp of the inner portion of the cap such that when the cap rotates relative to the spring mechanism from a first position to a second position, at least one ramp expands the spring mechanism; and In some embodiments, the sealing system can further comprise an insert engaged with the spring mechanism and expandable when the spring mechanism expands. The insert can have an outer surface for sealing against a bottle or container.

In some embodiments, the spring mechanism can be located between the inner portion of the cap and the insert. In some embodiments, when the cap is in the first position the insert can be in a contracted state, and when the cap is in the second position the insert can be in a sealing state. The outer surface of the insert can seal against a threadless neck of the bottle when the sealing system is in the sealing state.

In some embodiments, the threadless neck of the bottle comprises an undercut. In some embodiments, the sealing state can be substantially watertight. In some embodiments, the spring mechanism can expand radially outward when the cap rotates from the first position to the second position. In some embodiments, the spring mechanism can comprise at least one arm portion. In some embodiments, the cap comprises one or more detents to hold the cap in the first position, the second position, or both.

In some embodiments, the insert can comprise one or more ribs on the outer surface of the insert. The insert can also comprise a seal flange on the outer surface of the insert.

In some embodiments, the insert can comprise silicone. In some embodiments, the spring mechanism comprises nylon, polypropylene, or steel.

In some embodiments, the invention can comprise a variable-volume container system. The system can comprise a lid. The lid can comprise a rotating assembly having and outer surface and a top. The rotating assembly can have at least one ramp on the outer surface and can have a handle on the top.

The lid can further comprise a spring mechanism having an inner portion and an outer portion. The inner portion can be engaged with at least one ramp of the rotating assembly such that when the rotating assembly rotates relative to the spring mechanism from a first position to a second position, at least one ramp expands the inner portion of the spring mechanism outwardly.

The lid can further comprise a seal engaged with the outer portion of the spring mechanism and expandable when the spring mechanism expands. The seal can have an outer surface for sealing against a container.

In some embodiments, the outer portion of the spring mechanism can expand when the inner portion of the spring mechanism expands. The rotating assembly can also be disposed at least partially within the inner portion of the spring mechanism.

In some embodiments, when the rotating assembly is in the first position the lid can be in a contracted state, and when the rotating assembly is in the second position the lid can be in a sealing state. The container can also comprise an opening sized such that the lid can pass through the opening and into the container when the lid is in the contracted state. The seal can also seal against an inner wall of the container when the lid is in the sealing state. In some embodiments, the lid can be put in the sealing state in a plurality of locations within the variable-volume container such that the container has a variable amount of storage space below the lid.

These and other objects, features and advantages of the present invention will become more apparent upon reading the following specification in conjunction with the accompanying drawing figures.

DETAILED DESCRIPTION OF THE INVENTION

Figure 1A:
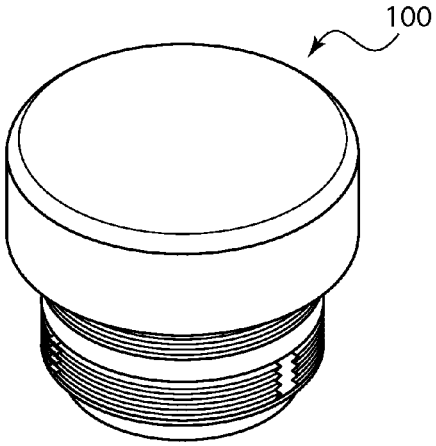
FIG. 1A illustrates an isometric view of a bottle cap assembly for use with a fluid container such as a reusable bottle, in accordance with some embodiments of the present invention.

To facilitate an understanding of the principles and features of the various embodiments of the invention, various illustrative embodiments are explained below. Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a system containing "a" component is intended to include other components in addition to the one named.

Also, in describing the preferred embodiments, terminology will be resorted to for the sake of clarity. It is intended that each term contemplates its broadest meaning as understood by those skilled in the art and includes all technical equivalents, which operate in a similar manner to accomplish a similar purpose.

Ranges may be expressed herein as from "about" or "approximately" one particular value and/or to "about" or "approximately" another particular value. When such a range is expressed, other exemplary embodiments include from the one particular value and/or to the other particular value.

The words "comprising," "containing," or "including" conveys that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

Embodiments of the present invention relate to a sealing system, and more specifically to a device for sealing a variety of containers. In some embodiments, the device provides an airtight and/or watertight seal. The device comprises, in a basic form, an eccentric element or ramp and a spring mechanism. In embodiments where an airtight or watertight seal is desired, the system can further include a sealing insert. The device can be used to seal a variety of shapes and sizes of containers. The device can further comprise a knob or handle to enable the ramp to be turned by hand. The spring mechanism can have an expanded position and an unexpanded position.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

As described above, a problem with conventional sealing systems is that they are not easily adaptable for use with a wide variety of containers. For example, the threaded cap found on reusable water bottles cannot easily be adapted for use with food storage containers, which are generally rectangular. Additionally, the hinged flip top provided on many reusable water bottles would be cumbersome if used on a large rectangular food storage container. Other known lids generally cannot provide a watertight seal, and are often knocked off containers when they are dropped.

Embodiments of the present invention, therefore, provide a system for creating a robust seal or lock for containers of a variety of shapes and sizes. A unique feature of the sealing system assembly is that it can expand and lock tightly in a bottle or container. The system expands radially out from the center causing the soft seal to grip the inside rim/neck of a bottle or container. The system eliminates the need for a traditional threaded connection between the neck of a bottle and a cap for the bottle.

The sealing system can be operated by first pushing the sealing mechanism assembly down into the container or bottle until it cannot go any further. Then turn the handle or gripping surface until it clicks in a locked position, creating a watertight and/or airtight seal. To remove the system from the bottle or container, turn the handle or gripping surface in the opposite direction. The mechanism will release and the seal will contract, allowing the system to be removed from the bottle or container.

The expanding sealing system can be used as a lid sealing mechanism across a variety of products. For example, it can be used in threadless water bottle and a food storage container.

In a basic form, the system comprises three parts: a hard plastic or metal cylindrical ramp, a flexible plastic spring mechanism, and a seal made from flexible rubber or silicone. The spring mechanism can be made of almost any flexible plastic, including nylon or polypropylene.

Figure 1B:
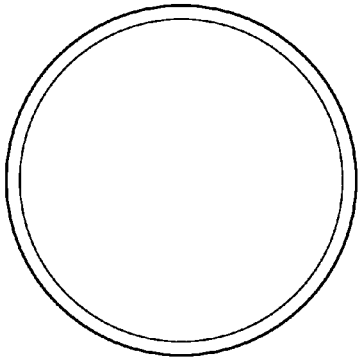
FIG. 1B illustrates a top view of the bottle cap assembly of FIG. 1A, in accordance with some embodiments of the present invention.
Figure 1C:
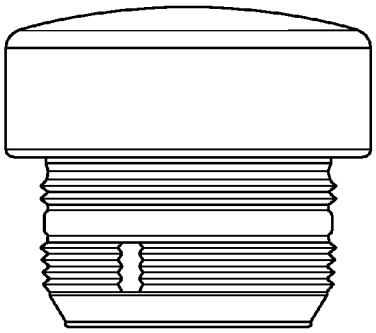
FIG. 1C illustrates a front view of the bottle cap assembly of FIG. 1A, in accordance with some embodiments of the present invention.
Figure 1D:
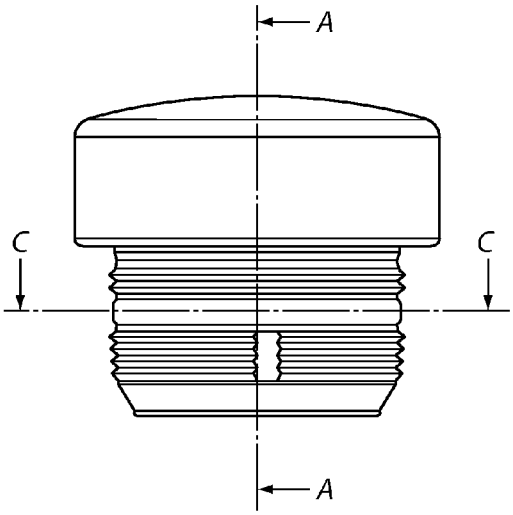
FIG. 1D illustrates a side view of the bottle cap assembly of FIG. 1A, in accordance with some embodiments of the present invention.
Figure 2:
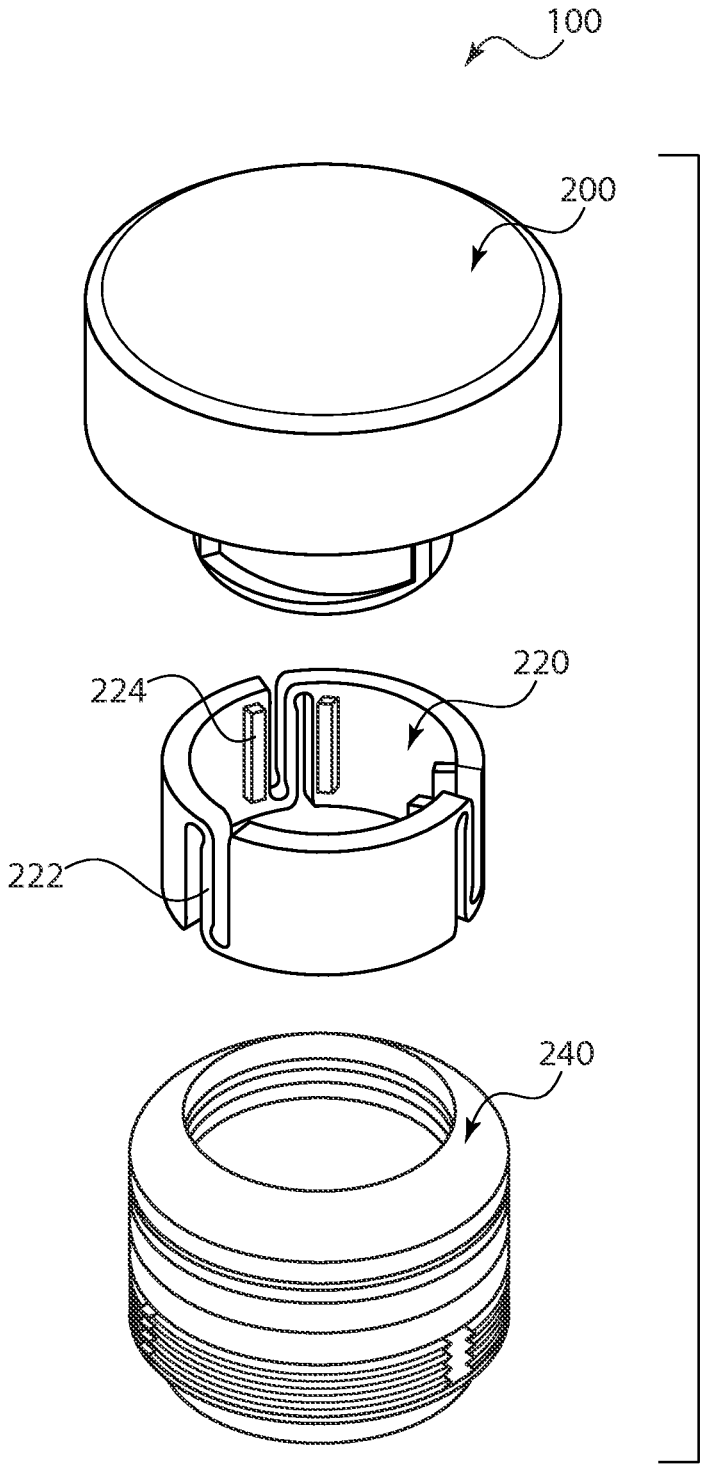
FIG. 2 illustrates an exploded view of a bottle cap assembly for use with a fluid container such as a reusable bottle, in accordance with some embodiments of the present invention.

Referring now in detail to the drawing figures, FIGS. 1A, 1B, 1C, and 1D show embodiments of the present invention providing a replaceable bottle cap assembly 100 including a portion that conforms to the top of a non-threaded beverage container. FIG. 1A is an isometric view of the bottle cap assembly 100, and FIGS. 1B, 1C, and 1D are top, front, and side views, respectively. As shown in FIG. 2, which is an exploded view of the bottle cap assembly 100, the assembly 100 comprises a grippable cap 200, a substantially circular spring mechanism 220, and an insert 240.

Figure 3:
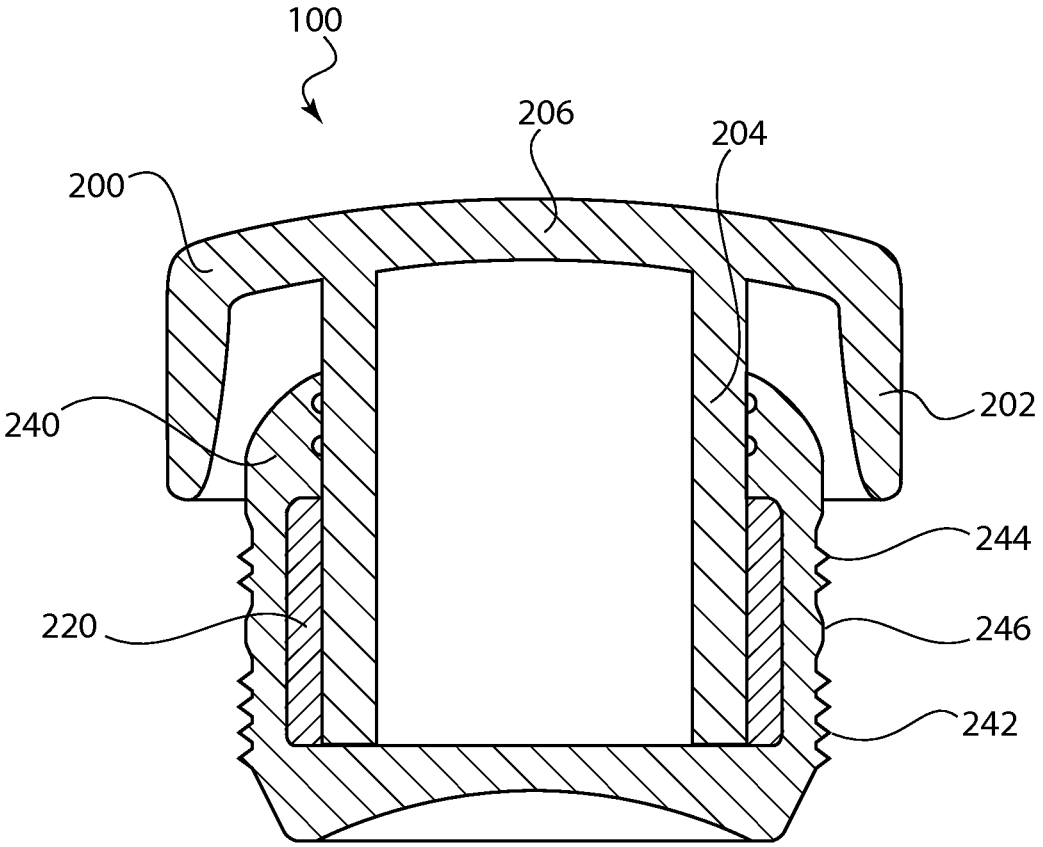
FIG. 3 illustrates a cross-sectional, side or front view of the bottle cap assembly of FIG. 1D along plane A-A, in accordance with some embodiments of the present invention.

FIG. 3 illustrates a side or front cross-section of the bottle cap assembly 100 of FIG. 1D along plane A-A. As shown in FIG. 3, the cap 200 can have an outer portion 202 and an inner portion 204. The inner portion 204 and the outer portion 202 can be joined together by a top portion 206 such that the entire cap 200 rotates when a user grips the outer portion 202 and turns it.

Figure 4:
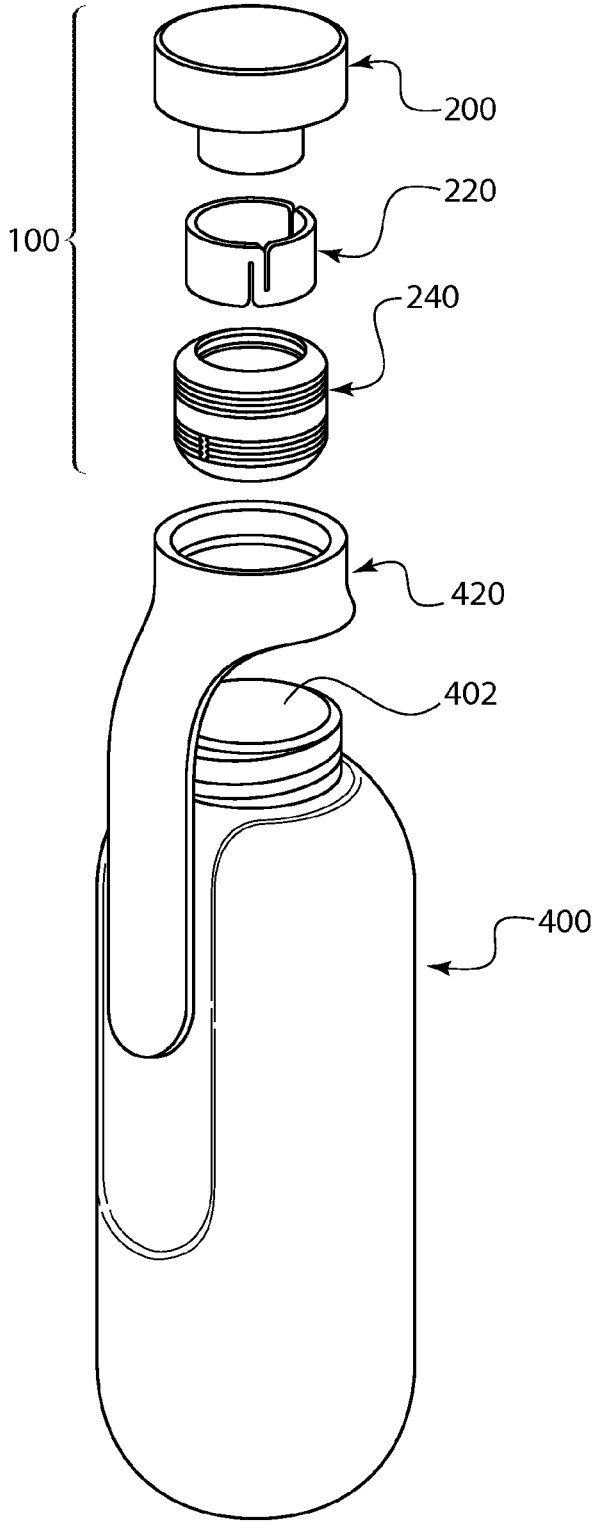
FIG. 4 illustrates an exploded view of a bottle cap assembly and a reusable bottle, in accordance with some embodiments of the present invention.

FIG. 4 shows an exploded view of a bottle cap assembly 100 of the present invention, and additionally shows a bottle 400 adapted to receive the bottle cap assembly 100 through an opening 402 of the bottle 400. The bottle 400 can also have a clip 420 that is adapted to receive at least a portion of the bottle cap assembly 100. The clip 420 can attach the bottle 400 to an article of clothing or another suitable object as desired by a user.

Figure 5:
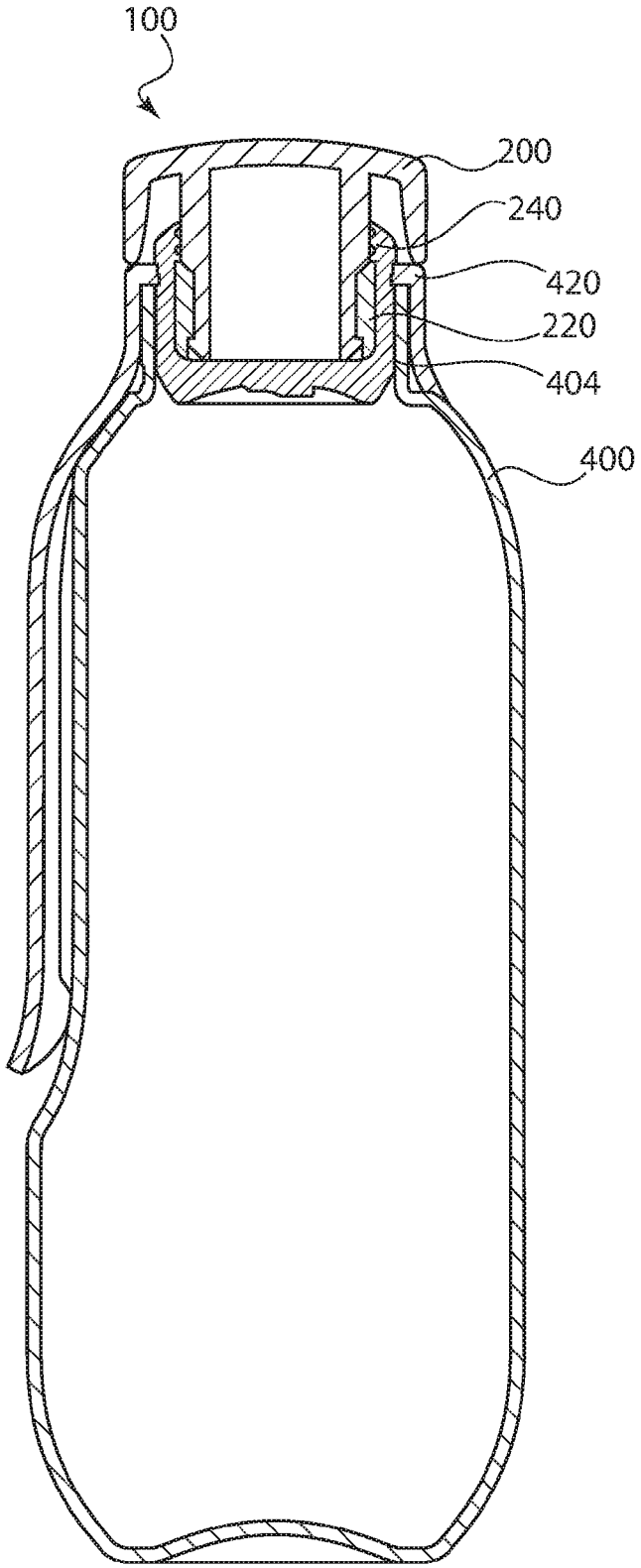
FIG. 5 illustrates a cross-sectional, side or front view of a bottle cap assembly that is sealing a reusable bottle, in accordance with some embodiments of the present invention.

As shown in FIG. 5, the bottle cap assembly 100 can fit into and seal the bottle 400. The bottle 400 has a neck with an inner rim 404 upon which the insert 240 of the bottle cap assembly 100 can be pressed to create a seal.

Figure 6A:
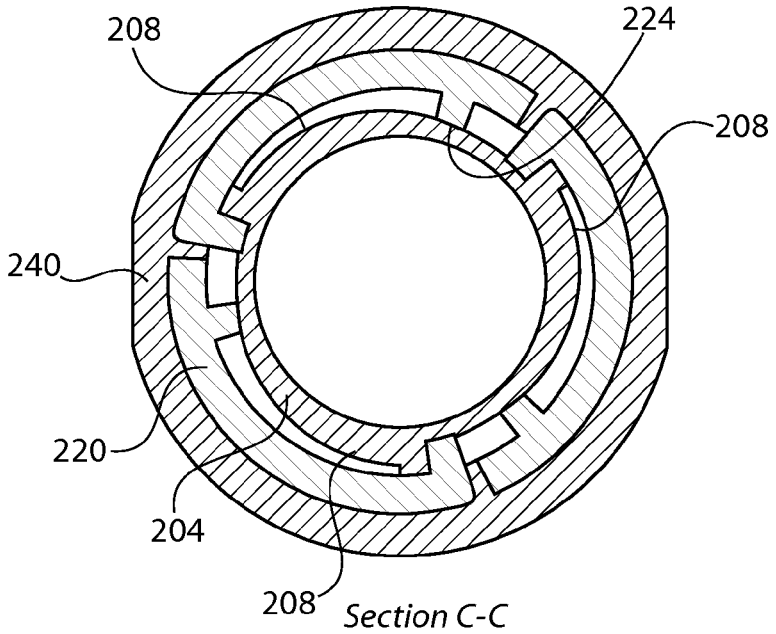
FIG. 6A illustrates a cross-sectional, top view of the bottle cap assembly of FIG. 1D along plane C-C with the assembly in a contracted position, in accordance with some embodiments of the present invention.
Figure 6B:
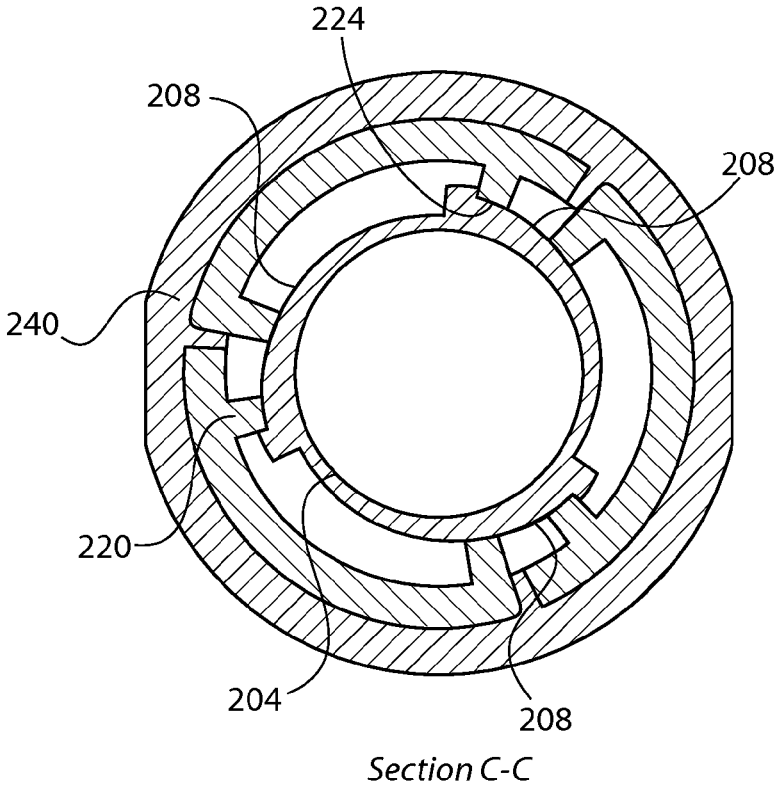
FIG. 6B illustrates a cross-sectional, top view of the bottle cap assembly of FIG. 1D along plane C-C with the assembly in an expanded position, in accordance with some embodiments of the present invention.

As shown in FIGS. 6A and 6B, which are cross-sections of the bottle cap assembly 100 of FIG. 1D from the top and along plane C-C, the cap 200 can have one or more ramps 208 on the outer surface of the inner portion 204. The ramps 208 can be in contact with the spring mechanism 220 such that when the ramps 208 rotate relative to the spring mechanism 220, at least one sliding surface 224 (see also FIG. 2) of the spring mechanism 220 slides up and along one or more of the ramps 208 and causes the spring mechanism 220 to expand radially outward. In some embodiments, the insert 240 can be disposed over the spring mechanism 220 and can be in contact with the spring mechanism 220 such that the insert 240 expands when the spring mechanism 220 expands. In these embodiments, the inner portion 204 of the cap 200 can be disposed substantially inside the spring mechanism 220 and the insert 240.

The cap 200 can have a first position and a second position relative to the spring mechanism 220. In the first position, shown in FIG. 6A, the spring mechanism 220, and thus the insert 240, can be in a contracted position. In the first position, the cap 200 can therefore be easily inserted and removed from an opening 402 of the bottle 400. As shown in FIG. 6B, the cap 200 can be turned to the second position relative to the spring mechanism 220, which can cause the ramp or ramps 208 on the inner portion 204 to force the spring mechanism 220 and the insert 240 into the expanded position. In some embodiments, when the cap 200 is turned to the second position and the inner portion 204 is inside of the bottle 400, the spring mechanism 220 is expanded such that it forces the insert 240 against an inner rim 404 of the neck of bottle 400 to create a seal.

In some embodiments of the present invention, the insert 240 is sized such that it can be easily inserted and removed from an opening 402 of a bottle 400 when the cap 200 is in the first position. The insert 240 can be sized so that it gently but frictionally rubs against an inner rim 404 of the neck of bottle 400 when the cap is in the first position. The insert 240 is also in contact with the spring mechanism 220 such that the insert 240 and the spring mechanism 220 rotate as one piece (i.e., the spring mechanism only rotates when the insert rotates). Thus, when a user inserts the cap 200 into the bottle 400 and turns the cap 200, the friction created between the insert 240 and the inner rim 404 is enough to substantially prevent the insert 240 from turning, which, as a result, substantially prevents the spring mechanism 220 from turning. This allows a user to turn the cap 200 relative to the spring mechanism 220 when the inner portion 204 of the cap 200, the spring mechanism 220, and the insert 240 are at least partially inside the bottle 400. The ability to turn the cap 200 in this manner allows a user to control when the spring mechanism 220 and the insert 240 are in the expanded and contracted positions. This allows the user to control when the cap assembly 100 can be removed from the bottle 400 and when it cannot, and when the bottle 400 is sealed and when it is not.

Referring back to FIG. 3, the insert 240 can comprise a suitably pliable material to form a watertight seal with the sides of the container. The insert can be substantially cylindrical. In some embodiments, the insert 240 can comprise one or more ribs to provide multiple sealing surfaces. In an exemplary embodiment, as shown in FIG. 3, the insert 240 includes lower grip ribs 242, upper double seal ribs 244, and a seal flange 246 therebetween. The ribs 242, 244 and seal flange 246 aid in holding the insert 240 and thus the inner portion 204 of the cap 200 inside of the bottle 400. The ribs 242, 244 and seal flange 246 therefore can help prevent the cap 200 from coming off of the bottle 400 when the bottle 400 is dropped. The ribs 242, 244 and seal flange 246 also aid in providing a watertight and/or airtight seal between the insert 240 and the bottle 400.

As discussed above, a spring mechanism 220 can be disposed within the insert 240. The spring mechanism 220 can comprise several shapes, and can be substantially cylindrical. As shown in FIG. 2, the spring mechanism 220 can comprise arm portions 222 that flex to allow the spring mechanism 220 to expand and contract more easily. The arm portions 222 can be rigid enough to help cause the spring mechanism 220 to contract to a state of equilibrium when the cap 200 is turned from the second position to the first position. The spring mechanism 220 can also comprise at least one sliding surface 224 that contacts and slides on one or more ramps 208.

In a preferred embodiment, the spring mechanism 220 can be co-molded to the insert 240, the insert 240 can be a stretch fit over the spring mechanism 220, and the inner portion 204 of the cap 200 can be snapped into the spring mechanism 220, all to present a single piece bottle cap assembly 100. In this configuration, the insert 240 can be removed easily for cleaning.

The components of the present invention can be manufactured from a variety of suitable materials, including but not limited to, plastic, nylon, fiberglass, and natural and synthetic rubbers. In some embodiments, the bottle 400 can comprise, for example and not limitation, aluminum, plastic, or stainless steel. The spring mechanism 220 can comprise, for example and not limitation, nylon, polypropylene, or spring steel. The insert 240 can comprise, for example and not limitation, natural or synthetic rubber, plastic, or silicone. In an exemplary embodiment, the cap 200 can be formed of acrylonitrile butadiene styrene (ABS), the insert 240 of silicone, and the spring mechanism 220 of nylon. Also in an exemplary embodiment, the bottle 400 can be formed of Tritan™ and the clip 402 can be formed of ABS.

Figure 7:
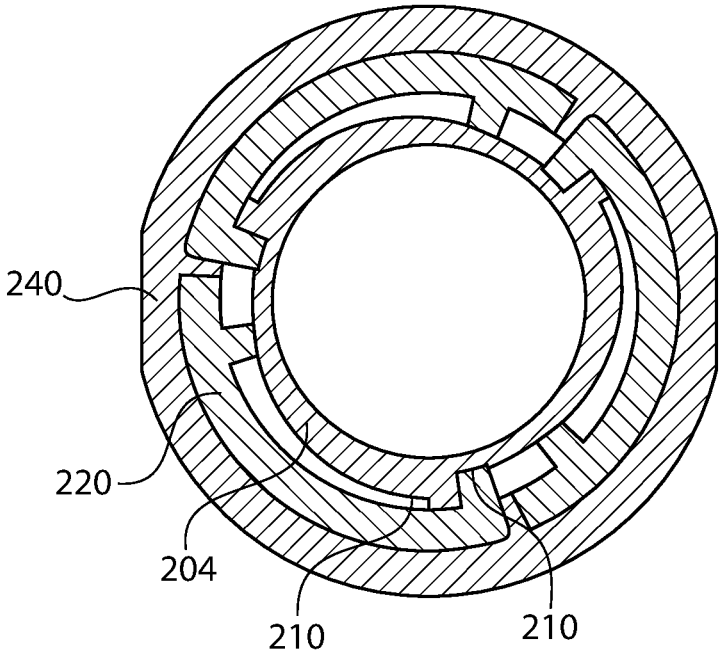
FIG. 7 illustrates a cross-sectional, top view of a bottle cap assembly being held in a contracted position by detents, in accordance with some embodiments of the present invention.
Figure 8:
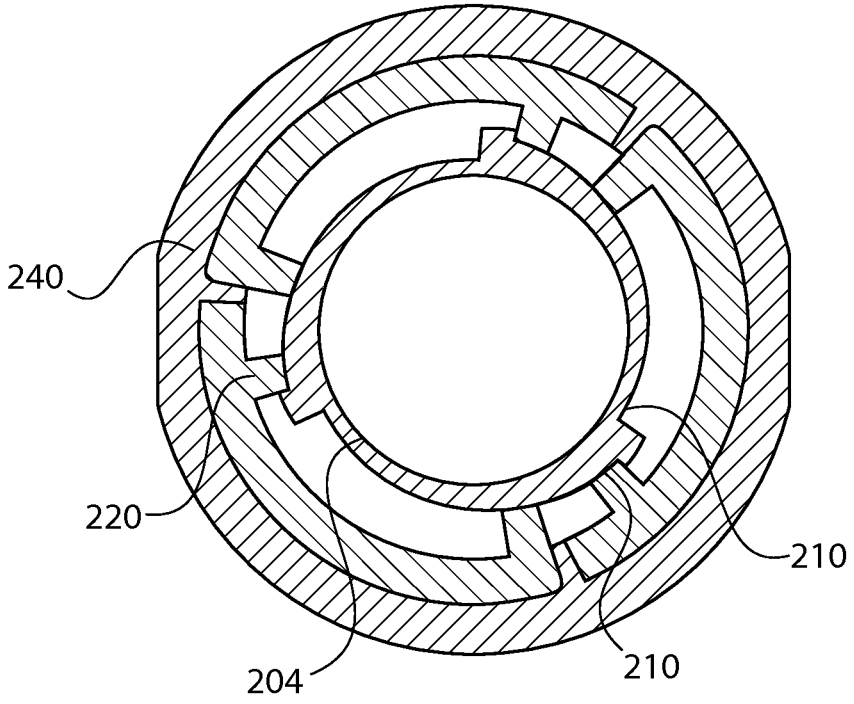
FIG. 8 illustrates a cross-sectional, top view of a bottle cap assembly being held in an expanded position by detents, in accordance with some embodiments of the present invention.

In some embodiments, shown in FIGS. 7 and 8, the inner portion 204 of the cap 200 and/or the spring mechanism 220 comprise one or more detents 210 to "lock" the cap in the first position, the second position, or both. The detents 210 can be, for example and not limitation, flat areas at one or both ends of the ramps 208. In some embodiments, the flat areas can receive at least some of the sliding surfaces 224 of the spring mechanism 220. The flat areas can therefore hold the sliding surfaces 224, and thus the spring mechanism 220 and the cap 200, in the first position, the second position, or both. The cap assembly 100 can be "unlocked" from either of these positions simply by applying a suitable twisting force to the cap 200. As shown in FIG. 7, some of the detents 210 can lock the cap assembly 100 in the first, contracted position, while the detents used to lock the cap assembly 100 in the second, expanded position are not in use. Alternatively, as shown in FIG. 8, some of the detents 210 can lock the cap assembly 100 in the second, expanded position, while the detents used to lock the cap assembly 100 in the first, contracted position are not in use.

This threadless top/expander technology of the present invention is useful as a means of sealing various bottles, containers, and jars. In some embodiments, the bottle cap assembly 100 works in a similar manner as a normal screw-on lid:

To lock the cap:

1. Push the cap assembly 100 straight into the bottle 400 until it stops.

2. Turn the cap 200 in a first direction until the detents 210 click or snap into the expanded position (a clockwise turn is preferred, but embodiments of the present invention can be manufactured so that the cap is turned clockwise or counter-clockwise to reach the expanded position). It is now locked.

To unlock the cap:

1. Turn the cap 200 in the direction opposite from the first direction to disengage the detents 210 and unlock the cap assembly 100 (can be clockwise or counter-clockwise).

2. Pull the cap assembly 100 out of the container.

Figure 9:
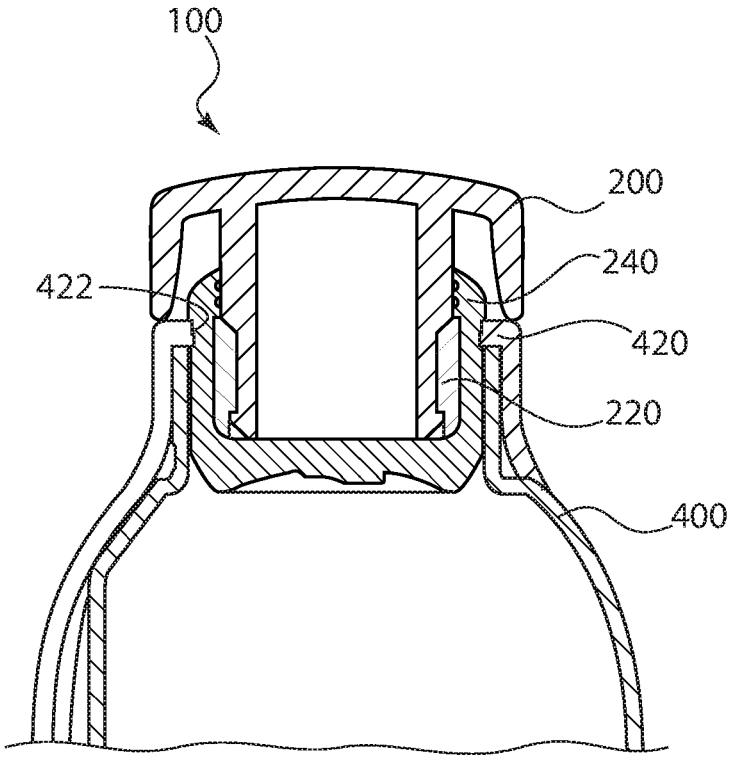
FIG. 9 illustrates a cross-sectional, side or front view of a bottle cap assembly sealing a reusable bottle with an undercut on the rim, in accordance with some embodiments of the present invention.

In some embodiments of the present invention, as shown in FIG. 9, the bottle 400 and/or the clip 420 can comprise an undercut 422 on the rim. In this configuration, the bottle cap assembly 100 can be placed inside the bottle 400, at least partially below the undercut 422, with the spring mechanism 220 and the insert 240 in the contracted position. The cap assembly 100 can then be placed in the expanded position such that the spring mechanism 220 and the insert 240 expand at least partially below the undercut 422, locking the cap assembly 200 into the bottle 400. In other words, because the spring mechanism 220 and the insert 240, when in the expanded position, are larger than the opening in the undercut on the bottle 400 and/or the clip 420, the bottle cap assembly 100 is effectively locked into the bottle 400. This configuration can help prevent the bottle cap assembly 100 from coming off of the bottle 400 during normal use or when the bottle 400 is dropped.

Embodiments of the present invention enable various containers, including but not limited to reusable water bottles, to be sealed without using a threaded closure. Since the grooves that form conventional threads trap debris and are difficult to clean, the present invention can enable easy cleaning because the neck of the bottle can be smooth and threadless. In addition, a threadless bottle is more comfortable to drink from due to the smooth outer surface, and also has a reduced tendency to drip in use.

Figure 10:
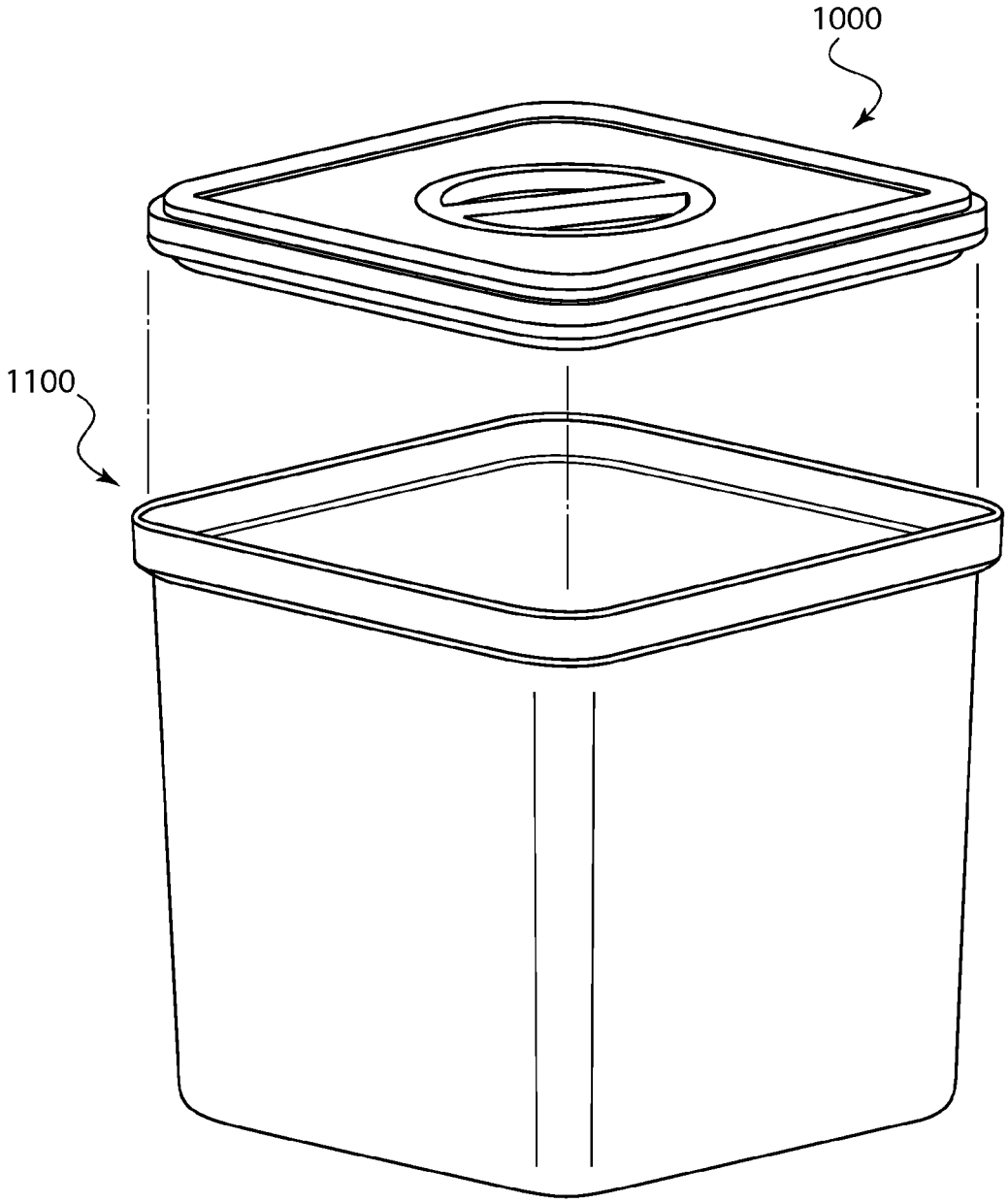
FIG. 10 illustrates an isometric view of a lid assembly and a storage container, in accordance with some embodiments of the present invention.
Figure 11:
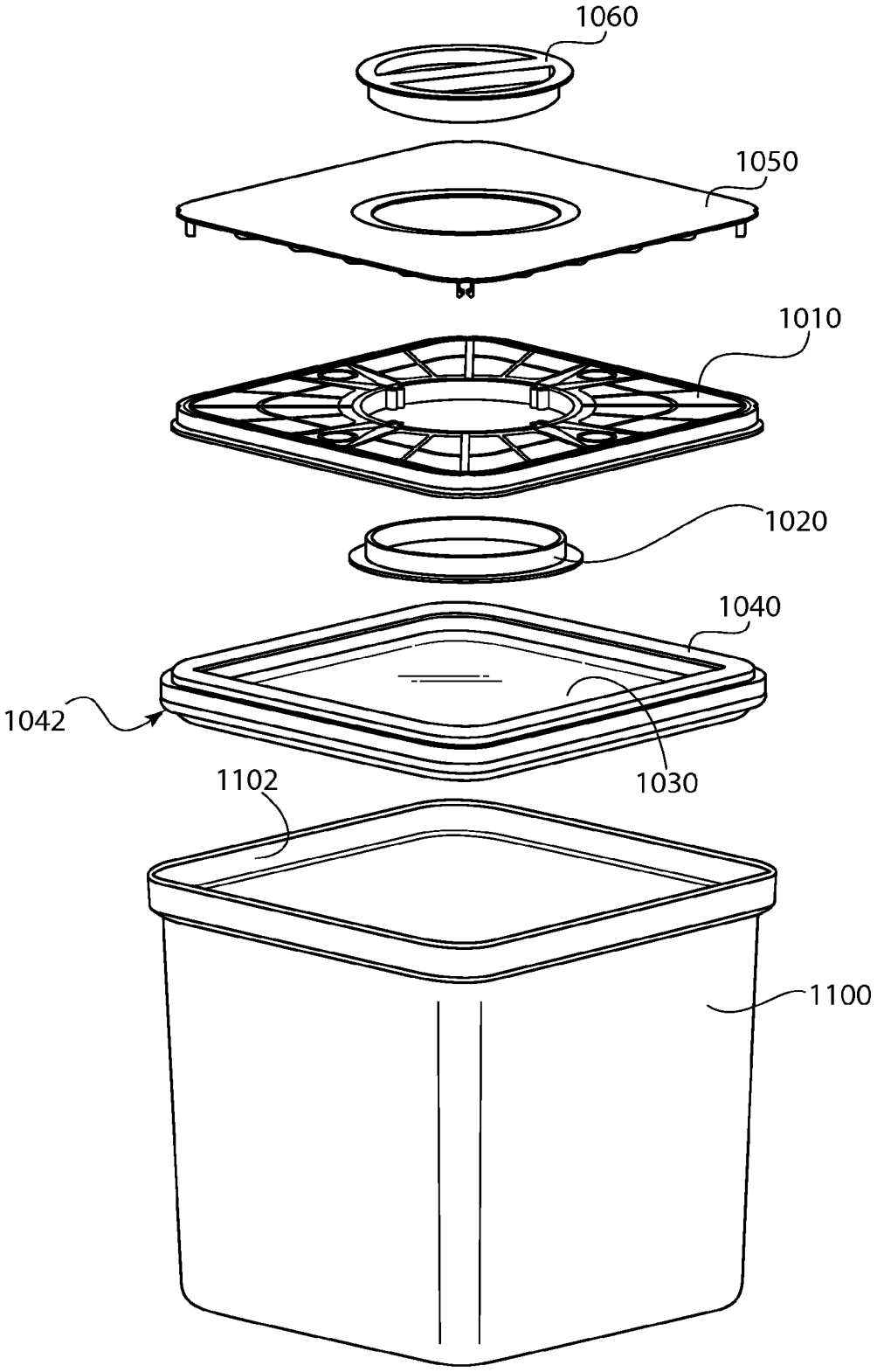
FIG. 11 illustrates an exploded view of a lid assembly and a storage container, in accordance with some embodiments of the present invention.

Embodiments of the present invention can also be configured to seal other types of containers. As shown in FIG. 10, embodiments of the present invention can comprise a lid assembly 1000 for sealing a food storage container 1100 that is, for example and not limitation, square or rectangular. As shown in FIG. 11, the lid assembly 1000 can comprise a spring mechanism 1010, an eccentric or ramp assembly 1020, a lower lid 1030, a seal 1040, an upper lid 1050, and a grippable handle 1060. In some embodiments, the lower lid 1030 and the seal 1040 can be combined into one part.

The lid assembly 1000 can be used to provide a positive watertight and/or airtight seal for the container 1100. The seal 1040 can comprise a material suitably pliable to provide the desired seal against the inner surface 1102 of the container 1100. The seal 1040 can comprise, for example and not limitation, natural or synthetic rubber, foam, or plastic. In a preferred embodiment, the seal 1040 can comprise silicone. In some embodiments, the seal 1040 can comprise a substantially smooth outer surface. In other embodiments, as shown in FIG. 11, the outer surface of the seal 1040 can comprise raised surfaces or ribs 1042 to provide multiple sealing surfaces against the inner surface 1102 of the container 1100. The ribbed configuration can provide sealing redundancy and a more effective seal as multiple sealing surfaces interact with the inner surface 1102 of the container 1100.

In some embodiments, the handle 1060 can be engaged with the ramp assembly 1020 to yield a rotating assembly. In this manner, the handle 1060 and the ramp assembly 1020 can rotate together such that when a user rotates the handle 1060, the ramp assembly 1020 also rotates. When the handle 1060 is turned, both the handle 1060 and the ramp assembly 1020 can therefore rotate relative to the spring mechanism 1010.

Figure 12:
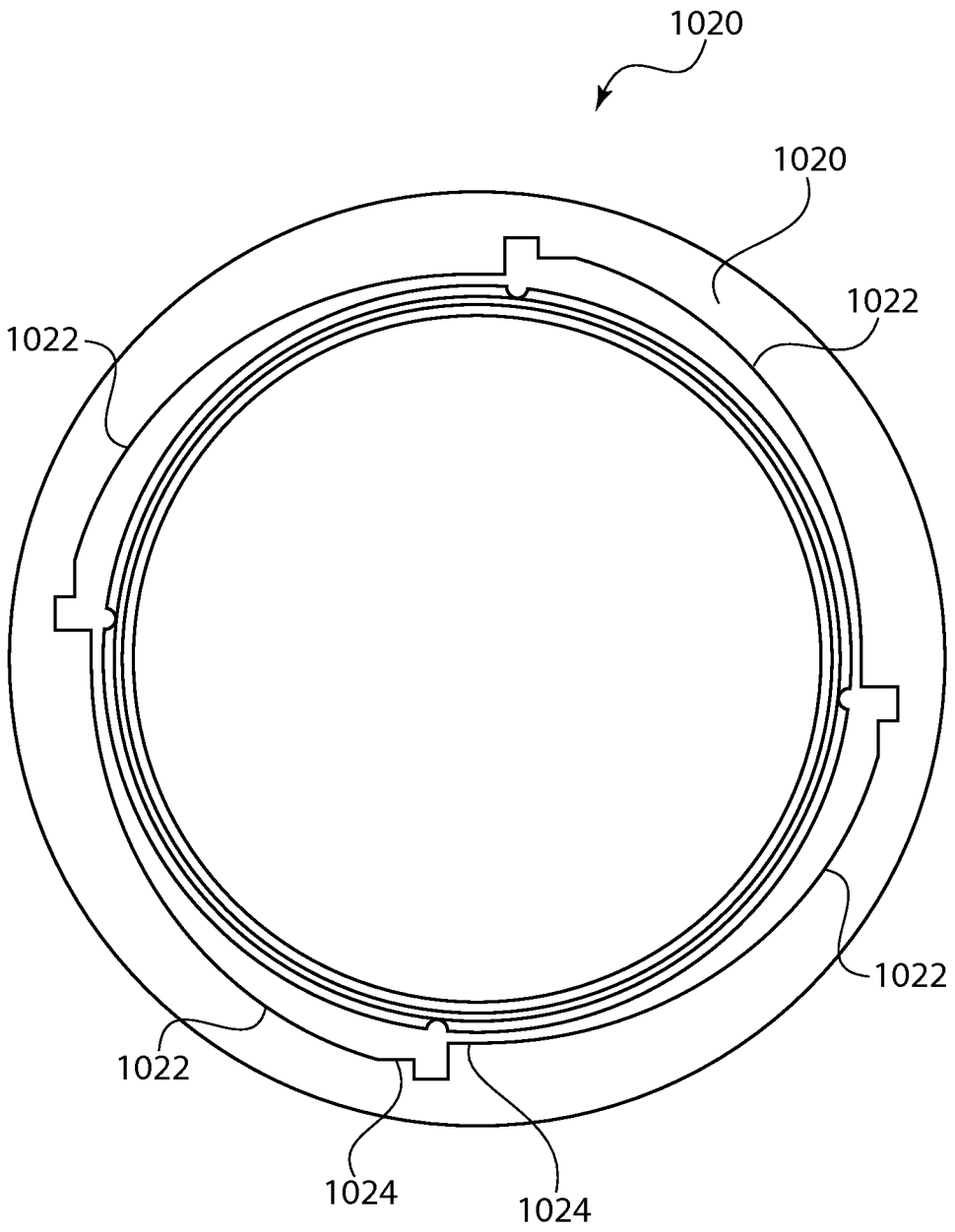
FIG. 12 illustrates a ramp assembly for use in a lid assembly, in accordance with some embodiments of the present invention.

FIG. 12 shows a close-up view of the ramp assembly 1020 of some embodiments of the present invention. As shown in FIG. 12, the ramp assembly 1020 can comprise one or more ramps 1022. In some embodiments, the ramp assembly 1020 can also comprise one or more detents 1024 to "lock" the rotating assembly in the first (contracted) position, the second (expanded) position, or both. The detents 1024 function in substantially the same manner as described above.

Figure 13:
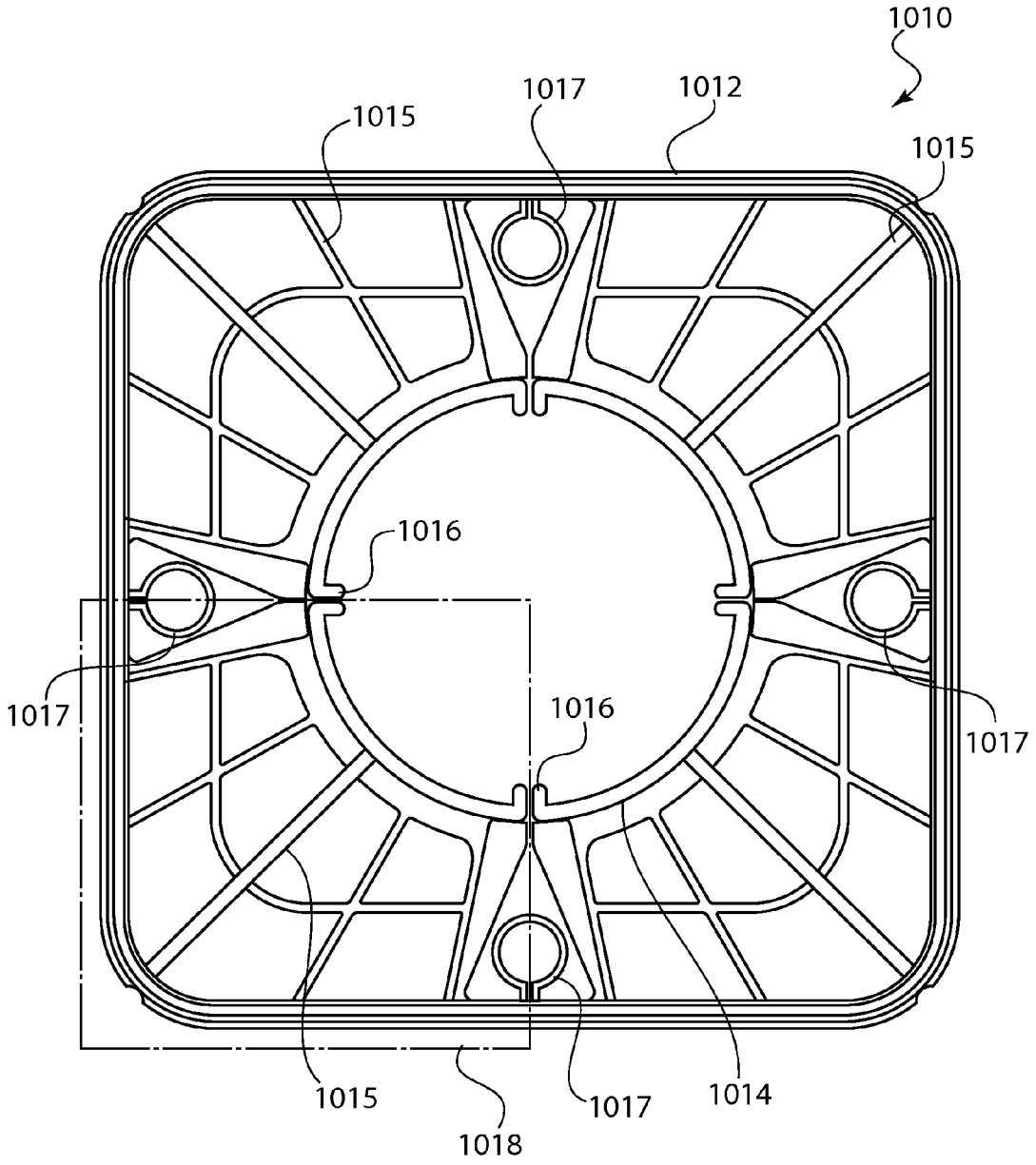
FIG. 13 illustrates a spring for use in a lid assembly, in accordance with some embodiments of the present invention.

FIG. 13 shows the spring mechanism 1010 of some embodiments of the present invention. The spring mechanism 1010 can comprise an outer portion 1012 and an inner portion 1014, and the inner portion 1014 and the outer portion 1012 can be connected by fingers 1015. In some embodiments, the spring mechanism 1010 can also comprise one or more sliding surfaces 1016 to slide along one or more ramps 1022 of the ramp assembly 1020. In some preferred embodiments, the spring mechanism 1010 can comprise flexible joints 1017 that connect multiple elements 1018 of the spring mechanism 1010. As shown in FIG. 13, the spring mechanism 1010 can comprise, for example and not limitation, four elements 1018 of approximately equal size and shape. In FIG. 13, for example and not limitation, there is a top left element, a top right element, a bottom left element (labeled as 1018 in FIG. 13), and a bottom right element. In some embodiments, when the handle 1060 is rotated into the second position, the flexible joints 1017 can expand so that the elements 1018 of the spring mechanism 1010 can expand outward and push the seal 1040 outward. The flexible joints 1017 can also be sufficiently rigid to cause the spring mechanism 1010 to contract when the handle 1060 is rotated back into the first position. In some embodiments, the flexible joints 1017 can be removed so that the spring mechanism is made from separate elements 1018. In these embodiments, the elasticity of the seal causes the spring mechanism 1010 to contract when the handle 1060 is rotated back into the first position.

Figure 14:
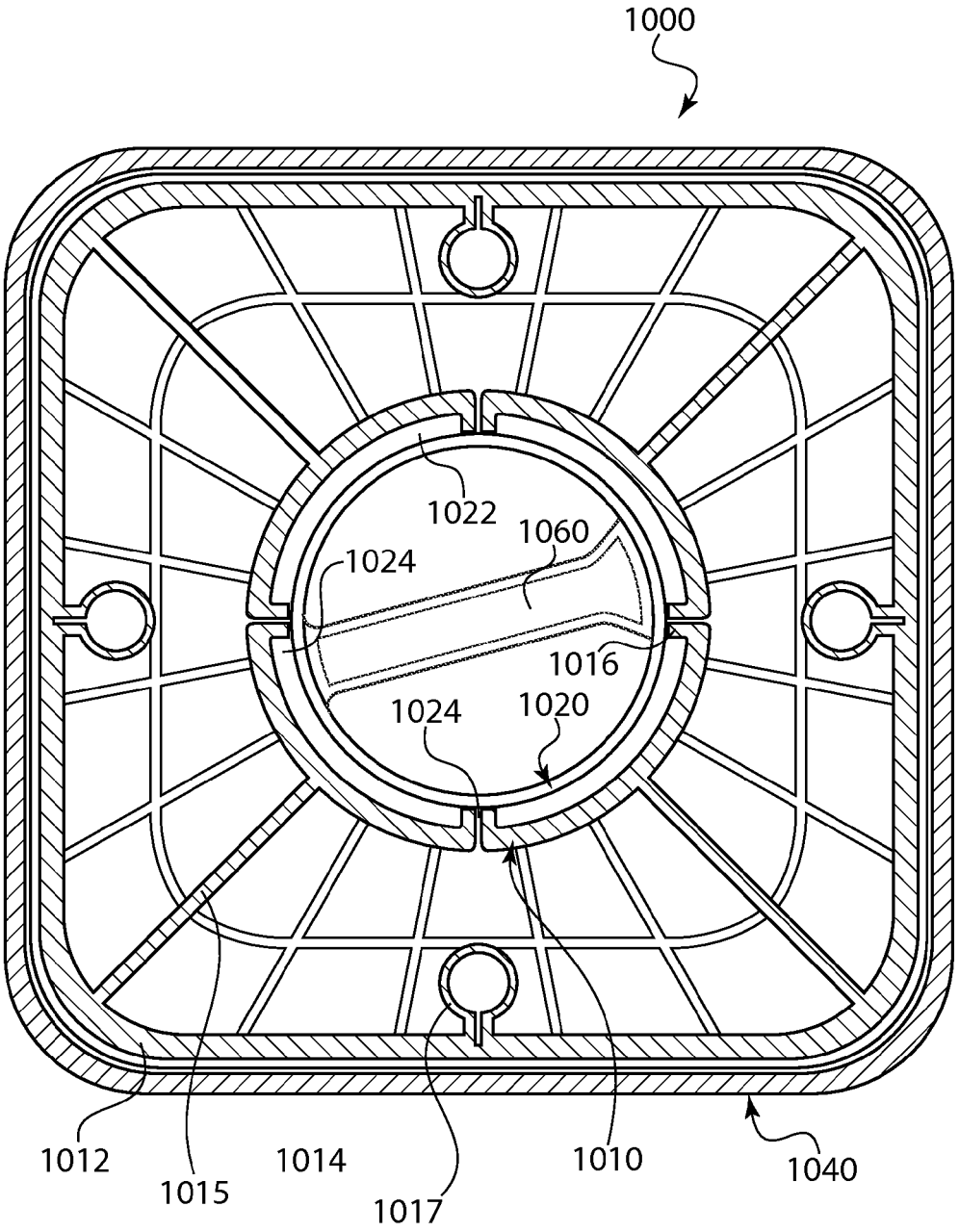
FIG. 14 illustrates a cross-sectional, top view of a lid assembly for use with a storage container, in accordance with some embodiments of the present invention.

FIG. 14 shows a close-up, top view of a cross-section of the lid assembly 1000 of some embodiments of the present invention. As shown in FIG. 14, in some embodiments, the sliding surfaces 1016 of the spring mechanism 1010 can be in contact with one or more ramps 1022 of the ramp assembly 1020 such that when the rotating assembly rotates relative to the spring mechanism 1010, the sliding surfaces 1016 of the spring mechanism 1010 slide up and along the ramps 1022 of the ramp assembly 1020 and cause the spring mechanism 1010 to expand. Thus, when the handle 1060 is in a first position, the inner portion 1014, the outer portion 1012, and the fingers 1015 of the spring mechanism 1010 can be contracted. This, in turn, means the seal 1040 can also be in a contracted position, which allows the lid assembly 1000 to be inserted into, or removed from, a container 1100. When the handle 1060 is rotated to a second position, the ramp assembly 1020 can rotate to cause the inner portion 1014 and thus the fingers 1015 of the spring mechanism 1010 to expand outwardly. This outward expansion of the inner portion 1014 and the fingers 1015 causes the outer portion 1012 of the spring mechanism 1010 to expand, which, in turn, pushes the seal 1040 against the inner surface 1102 of the container 1100 to seal the container 1100.

Figure 15:
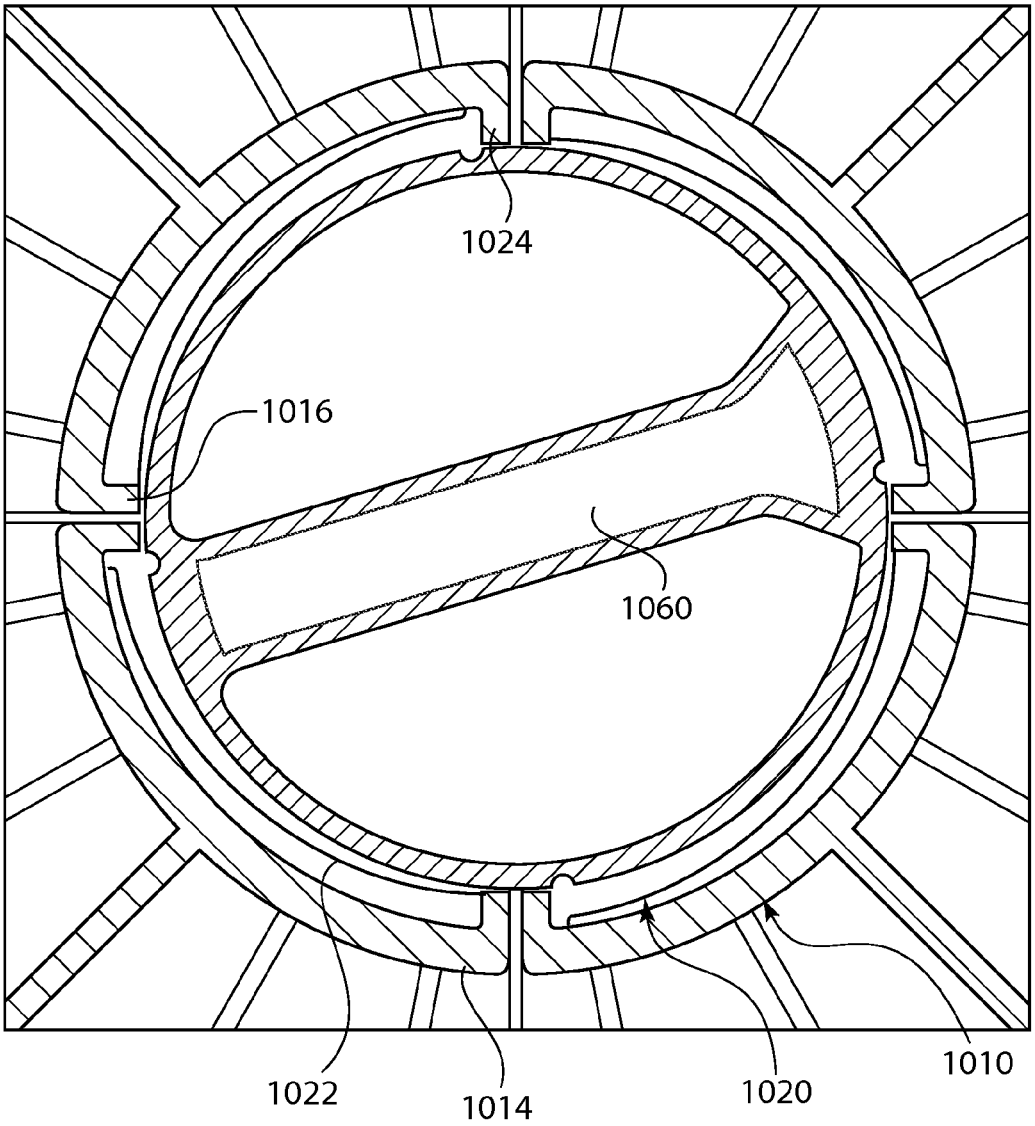
FIG. 15 illustrates a cross-sectional, top view of a portion of a lid assembly for use with a storage container, in accordance with some embodiments of the present invention.

FIG. 15 shows a close-up, cross-sectional view of the handle 1060, ramp assembly 1020, and the inner portion 1014 of the spring mechanism 1010 in accordance with some embodiments of the present invention. In FIG. 15, the rotating assembly is in the first position, and the spring mechanism 1010 is therefore contracted. If the rotating assembly were rotated counter-clockwise into the second position, the sliding surfaces 1016 of the spring mechanism 1010 would slide up and along the ramps 1022 of the ramp assembly 1020, forcing the spring mechanism 1010 into an expanded position.

In some embodiments, the handle 1060, the upper lid 1050, the lower lid 1030, the ramp assembly 1020, the spring mechanism 1010, and the container 1100 can be cast or molded out of a suitably rigid material. In a food or beverage storage capacity, for example, these elements are preferably suitably smooth and resistant to food-born pathogens such as mold, mildew, bacteria, and viruses to enable easy clean up and provide safe use. The spring mechanism 1010 can comprise a similar material, but should also be suitably resilient to repeatedly expand and contract and to provide some "spring" tension against the seal 1040. These elements can comprise, for example and not limitation, nylon, polypropylene, or spring steel. In a preferred embodiment, all elements except the seal 1040 are pressure injection molded out of a suitable thermoplastic and the seal 1040 is silicone.

In use, the lid assembly 1000 can be placed inside the container 1100 in the first position. In this position, the spring mechanism 1010 can be in the contracted position, such that the seal 1040 is slightly smaller than the inner surface 1102 of the container 1100. This can enable the lid assembly 1000 to be easily positioned inside the container 1100. Once in place, the handle 1060 can be rotated from the first position to the second position. Rotating the handle 1060 rotates the ramp assembly 1020, which in turn forces the spring mechanism 1010 outward, i.e., towards the inner surface 1102 of the container 1100. The expanding spring mechanism 1010 can then push the seal 1040 against the inner surface 1102 of the container 1100, providing a positive seal.

Embodiments of the present invention provide numerous advantages over conventional designs. When closing a conventional screw cap with an o-ring, for example, the o-ring is forced to rub against the sealing surface of the container as it closes. This rotational friction causes wear on the o-ring, while the pressure required to create a seal between the o-ring and the container tends to flatten and distort the o-ring with repeated use. These factors both contribute to reduced o-ring life and/or improper sealing over time.

In contrast, embodiments of the present invention apply pressure to the seal 1040 in a direction normal to the sealing surface. In this manner, the seal 1040 can be tightly applied to the container 1100 with little or no rubbing friction. In some embodiments, as mentioned above, the seal 1040 can also comprise multiple sealing ribs 1042. This can reduce the pressure required to provide a positive seal against the container 1100, which, in turn, can reduce the pressure on the seal 1040, can prevent the seal 1040 from distorting, and can increase the life of the seal 1040.

In addition, embodiments of the present invention are not restricted to use with a single type, size, or shape of container 1100. This is advantageous because a conventional screw cap can only be used on a container with a round opening. Embodiments of the present invention can be used, for example and not limitation, on round, square, pentagonal, hexagonal, octagonal, and rectangular containers without departing from the spirit of the invention. In other words, by changing the shape of the upper and lower lids 1050, 1030, the spring mechanism 1010, and the seal 1040, the present invention can accommodate a variety of containers. In addition, because these parts can be injection molded, for example, multiple shapes can be manufactured merely by changing molds.

Embodiments of the present invention can also comprise a lid assembly 1000 comprising a ramp assembly 1020 and a spring mechanism 1010, without a seal 1040. In this configuration, the lid assembly 1000 can be used to secure a variety of vessels that do not require an airtight or watertight seal. In some embodiments, the ramp assembly 1020 and spring mechanism 1010 can act on a friction ring to hold the lid in place frictionally. In other embodiments, the spring mechanism can have tabs that protrude from the lid in the locked position to engage matching slots in the container. This can enable the lid to secure the contents of the container during shipping, for example.

In some embodiments, the lid assembly 1000 can be used to create a variable volume container 1100. In other words, the container 1100 can have a consistent cross section in the vertical direction and the lid assembly 1000 can be secured at many locations along the height of the container 1100. In this configuration, a single container 1100 can be used to ship or store different volumes of materials or items with different shapes. In this manner, though the items or materials may occupy different volumes in the shipping container 1100, the items therein can nonetheless be secured. This, in turn, can prevent, among other things, damage to the items and weight shifting in the container.

In some embodiments, the lid assembly 1000 can comprise tabs that protrude from the lid assembly 1000 in the locked, expanded position. In addition, the container 1100 can have multiple sets of slots disposed along the height of the container 1100. In use, the lid assembly 1000 can be placed at the appropriate height on, or above, the contents of the container 1100 and then locked into the appropriate set of slots. This can substantially prevent the lid assembly 1000 from becoming dislodged due to shifting cargo. Of course, similar results can be achieved using sufficient spring force and the resultant friction of the lid assembly 1000 against the container 1100.

In other embodiments, a double-sided version of the present invention can be used to join two containers or bottles together. In other words, the device can comprise a single lid or cap with two locking/sealing components. In this configuration, a first side of the device can be placed in a first container or bottle, such that a second side is left protruding from the container or bottle, and locked in place. A second container or bottle can then be placed over the second side of the device, and the device locked in place. In this configuration, numerous containers or bottles can be locked together to form, for example and not limitation, a larger container or a pipe.

While several possible embodiments are disclosed above, embodiments of the present invention are not so limited. For instance, while several possible configurations have been disclosed (e.g., a bottle cap and a storage container lid), other suitable materials and configurations can be selected without departing from the spirit of embodiments of the invention. The present invention with suitably durable components (e.g., metal components), for example, can be used to seal 55-gallon drums or oil drums. In addition, the location and configuration used for various features of embodiments of the present invention can be varied according to a particular lid size and weight, a particular sealing requirement, or simply user preference. Such changes are intended to be embraced within the scope of the invention.

The specific configurations, choice of materials, and the size and shape of various elements can be varied according to particular design specifications or constraints requiring a device, system, or method constructed according to the principles of the invention. For example, while certain exemplary ranges have been provided for thicknesses and locations, other configurations can be used for different sized containers or cargos. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A threadless container sealing system comprising:

a cap having an inner portion and an outer portion joined by a top portion, the inner and outer portions being substantially cylindrical and extending downwardly from the top portion, the inner portion having at least one ramp disposed on an outer surface of the inner portion, and having one or more detents configured to hold the cap in a first position and one or more detents configured to hold the cap in a second position, the one or more detents configured to hold the cap in the first position being different from the one or more detents configured to hold the cap in the second position, wherein the one or more detents configured to hold the cap in the first position includes a first detent and the one or more detents configured to hold the cap in the second position includes a second detent;

a substantially cylindrical spring mechanism disposed on the inner portion of the cap and engaged with the at least one ramp of the inner portion of the cap such that when the cap rotates relative to the spring mechanism from the first detent configured to hold the cap in the first position to the second detent configured to hold the cap in the second position, the at least one ramp expands an inner portion of the spring mechanism outwardly, wherein the spring mechanism comprises at least one arm portion configured to flex to allow at least one of expansion or contraction of the spring mechanism, said at least one arm portion being rigid to cause the spring mechanism to contract to a state of equilibrium when the cap is rotated from the second position to the first position; and an insert engaged with the spring mechanism and expandable when the spring mechanism expands, the insert having an outer surface for sealing, the insert being in a contracted state when the cap is in the first position and in a sealing state when the cap is in the second position, the spring mechanism being located between the inner portion of the cap and the insert, wherein prior to insertion into a threadless container, the inner portion of the cap is snapped into the spring mechanism to present a single piece bottle cap assembly.

2. The system of claim 1, wherein the spring mechanism expands radially outward when the cap rotates from the first position to the second position.

3. The system of claim 1, wherein the insert comprises one or more ribs on the outer surface of the insert.

4. The system of claim 1, wherein the threadless container comprises an opening; and the outer surface of the insert seals the opening of the threadless container when the insert is in the sealing state.

5. The system of claim 4, wherein the sealing state is substantially watertight.

6. The system of claim 1, wherein the insert comprises silicone.

7. The system of claim 1, wherein the top portion is configured to connect two containers using a double sided cap with two sealing components.

8. A sealing system for sealing a bottle, the sealing system comprising:

a cap having an inner portion and an outer portion joined by a top portion, the inner and outer portions being substantially cylindrical and extending downwardly from the top portion, the inner portion having at least one ramp disposed on an outer surface of the inner portion, and having one or more detents configured to hold the cap in a first position and one or more detents configured to hold the cap in a second position, the one or more detents configured to hold the cap in the first position being different from the one or more detents configured to hold the cap in the second position, wherein the one or more detents configured to hold the cap in the first position includes a first detent and the one or more detents configured to hold the cap in the second position includes a second detent;

a substantially cylindrical spring mechanism disposed on the inner portion of the cap and engaged with the at least one ramp of the inner portion of the cap such that when the cap rotates relative to the spring mechanism from the first detent configured to hold the cap in the first position to the second detent configured to hold the cap in the second position, the at least one ramp expands an inner portion of the spring mechanism outwardly, wherein the spring mechanism comprises at least one arm portion configured to flex to allow at least one of expansion or contraction of the spring mechanism, said at least one arm portion being rigid to cause the spring mechanism to contract to a state of equilibrium when the cap is rotated from the second position to the first position; and an insert engaged with the spring mechanism and expandable when the spring mechanism expands, the insert having an outer surface for sealing, the outer surface configured to seal against a neck of the bottle when the sealing system is in a sealing state, and the spring mechanism is located between the inner portion of the cap and the insert, wherein prior to insertion into the bottle, the inner portion of the cap is snapped into the spring mechanism to present a single piece bottle cap assembly, and the insert is in a contracted state when the cap is in the first position, and the insert is in the sealing state when the cap is in the second position.

9. The system of claim 8, wherein the spring mechanism expands radially outward when the cap rotates from the first position to the second position.

10. The system of claim 8, wherein the sealing state is substantially watertight.

11. The system of claim 8, wherein when the neck of the bottle comprises an undercut, said cap is configured to attach to the neck such that the insert expands at least partially below said undercut.

12. The system of claim 8, wherein the insert comprises one or more ribs on the outer surface of the insert.

* * * * *